United States Patent [19]

Fleissner

[11] Patent Number: 4,570,361

[45] Date of Patent: Feb. 18, 1986

[54] SIEVE DRUM DEVICE WITH FLAME HEATING

[75] Inventor: Heinz Fleissner, Riehen, Switzerland

[73] Assignee: Vepa Aktiengesellschaft, Switzerland

[21] Appl. No.: 388,241

[22] Filed: Jun. 14, 1982

[30] Foreign Application Priority Data

Jun. 13, 1981 [DE] Fed. Rep. of Germany ..... 3123564

[51] Int. Cl.[4] ..... F26B 13/22

[52] U.S. Cl. ..... 34/115; 34/122; 432/8

[58] Field of Search ..... 34/110, 115, 122; 432/8, 58

[56] References Cited

U.S. PATENT DOCUMENTS 3,476,367 11/1969 Fleissner ..... 34/115

3,893,246 7/1975 Fleissner ..... 34/115

FOREIGN PATENT DOCUMENTS 2110705 9/1972 Fed. Rep. of Germany .

*Primary Examiner*—Larry I. Schwartz

*Assistant Examiner*—David W. Westphal

*Attorney, Agent, or Firm*—Antonelli, Terry & Wands

[57] ABSTRACT

A device for drying textile material has a closed housing accommodating a conveying means comprising a sieve drum that is under a suction draft and that is covered to prevent flowthrough of gases in the zone not contacted by the textile material; a fan associated with an end face of the sieve drum for withdrawing the gaseous treatment medium from the sieve drum and for blowing the gaseous treatment medium back into a space around the sieve drum; and an annular gap provided between a fan intake connection, or duct, and a wall provided with the drum spider for supporting the sieve drum. The gap is surrounded by an annular duct open toward the gap into which terminates burners of a direct flame heating unit for heating said gaseous treatment medium.

12 Claims, 3 Drawing Figures

SIEVE DRUM DEVICE WITH FLAME HEATING

The invention relates to a sieve drum device for heating textile materials. A similar device is described in DOS 2,110,705. The device serves for the heat treatment, for example, drying and polymerization and condensation of synthetic resin impregnations and/or for the thermosetting of web- or strip-shaped textile material containing preferably natural or synthetic fibers. The device has a closed housing accommodating as the conveying element at least one sieve drum which is under a suction draft and is covered in the zone not contacted by the textile material; the sieve drum is associated at its end face with a fan for taking in the treatment medium from the sieve drum and for exhausting the medium back into a space around the sieve drum. An annular gap is provided, between a fan intake connection and the wall associated with the drum spider for supporting the sieve drum, for feeding the gases of a direct flame heating unit into the treatment medium cycle; the annular gap is surrounded by an annular duct (ring channel) open toward the gap, the burner terminating into this annular duct.

Devices of this type have proven themselves in many practical applications. This type of heating is most advantageous from an energy viewpoint since heat transfer losses, unavoidable in indirect heating, are not encountered. The sole problem in direct flame heating is the uniform treatment of the textile material, but this problem has been solved by means of the construction described heretofore. The flame gases enter directly into the suction nipple or intake of the fan. The taken-in air is accelerated within the fan while intermixed with these hot gases and thus is blown into the treatment chamber in a uniformly heated state.

At the beginning of a drying step, the textile material entering the dryer is not only cold but also carries a maximum amount of moisture. Thus, it is advantageous to treat the material immediately at the beginning of the drying step with a higher heating energy than toward the end of the procedure. The initially applied heating energy can even be so high that, with the material being increasingly dried, it would lead to burning of fibers. However, the layer of liquid around the fibers at the beginning of the drying step, which must first be heated up, prevents this from happening.

The invention is based on the problem of developing, especially in connection with a single-drum device, an arrangement for direct flame heating which, while ensuring a uniform heating up of the treatment medium, makes it possible to subject the air flowing away from the fan to purposely different heating in order to obtain not only a higher drying efficiency of this single-drum device, but also to save energy.

This problem has been solved according to the invention by providing that the fan intake connection; e.g., nipple or coupling, is associated, at a spaced distance therefrom, with two burners; preferably, the topside and underside of the fan intake connection each has its own burner with a, respectively, adjoining annular duct. It is possible in this way to design the upper burner to be more intense, with the material entering at the top of the sieve drum, so that the flame gases entering at the upper region of the fan intake connection into the fan, and also heated treatment air exiting again in the upper region from the fan, are hotter than the air exiting at the bottom. In this way, a variegated treatment of the textile material on one drum is possible in a controlled fashion without the treatment air being different overall in an uncontrolled fashion.

The air entering the fan intake connection at a specific point will exit from the fan offset by an angle which remains the same, depending on the construction of the fan. The treatment air taken in at the upper region of the fan intake connection exits again with a lag of 50°—seen in the direction of rotation of the fan. Thus, it is advantageous if the burners are arranged at the top and at the bottom in front of the perpendicular (normal) by an angle opposed to the direction of rotation of the fan, in order to maintain the condition of a differently heated treatment air in the upper and lower regions. This angle in this case need not amount to 50°, inasmuch as the textile material, in a single-drum dryer, first is fed to the upper zone of the sieve drum, and thus the sieve drum is covered over an angle on the topside against the suction draft. Therefore, it is sufficient, for example, to offset the upper burner at an angle of about 10° in front of the perpendicular against the direction of rotation of the fan and/or of the sieve drum, in order to obtain a flow of feed air with a higher heating energy in the zone where the textile material has already contacted the sieve drum and is to be exposed to the throughflow treatment of heated air.

It is necessary to continuously remove the air, enriched with moisture during the drying step, from the dryer through an exhaust flap; this air is replaced at the sieve drum by fresh air introduced from outside the unit. At that location, the air is simultaneously utilized for cooling the material. To preserve energy, it is now made possible to avoid reheating of the air to be removed via the exhaust flap in the fan chamber, directly before exhausting. This has been made feasible according to the invention by providing that, in the zone where the exhaust air is blown off from the fan, air which has not been heated is allowed to flow through the blades of the fan. Taking the fact into account that the air exhausted by the fan was taken in about 50° previously, the annular duct for feeding the flame gases thus must be recessed in a region corresponding to the exhaust flap. Therefore, in a zone of about 40°, the air taken in by the fan is not reheated, and directly thereafter this cooler air is removed into the exhaust duct.

The accompanying drawing shows one embodiment of the device according to this invention with still additional inventive features. In the drawing.

Figure 2:
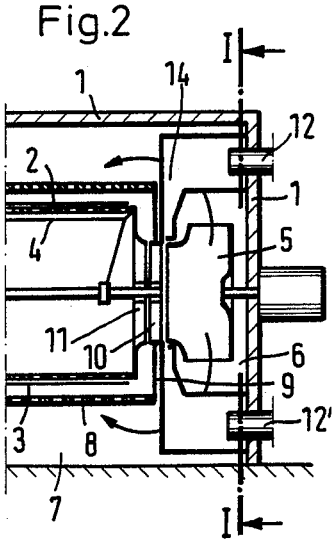
FIG. 2 shows a longitudinal cross-sectional view of the sieve drum device shown in FIG. 1.
Figure 3:
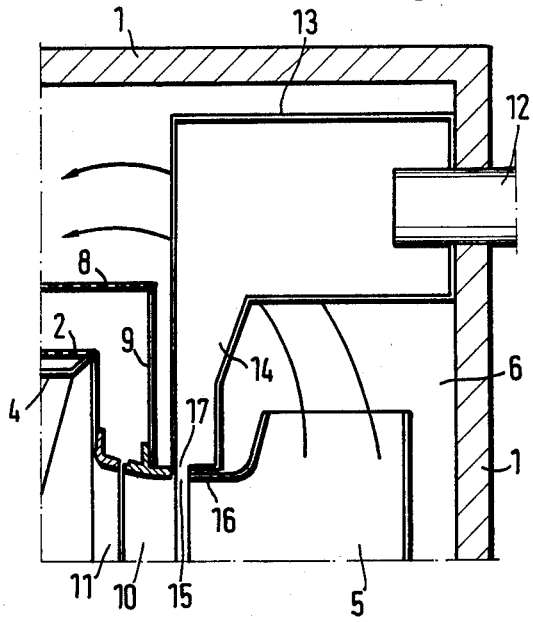
FIG. 3 shows a partial cross-sectional view of the upper portion of the fan chamber as shown in FIG. 2 in an enlarged illustration.

The sieve drum device consists of a heat-insulated housing 1 wherein a large sieve drum 2 is rotatably supported. The textile material 3 travels tangentially toward the topside of the sieve drum 2 while being held under tension in tenter chains, not illustrated. The sieve drum is covered against the suction draft by a cover 4 in the zone not contacted by the textile material. The suction draft within the sieve drum is produced by a radial-flow fan 5 arranged at the end portion in the fan chamber 6 and supported in the housing wall 1. In case of a large-size drum dryer, another fan, such as shown in FIG. 2, is advantageously arranged also on the other end portion of the sieve drum 2. The air conveyed by the fan 5 enters from the fan chamber 6 above and below the sieve drum 2 into the treatment chamber 7 from where the air flows through the screens 8 through the textile material 3 into the interior of the sieve drum 2. The screens 8 are supported on the wall 9 providing the separation between the fan chamber 6 and the treatment chamber 7 and being, in turn, supported by the drum spider 10. The drum spider, in turn, serves for supporting the sieve drum 2, the jacket of the latter resting on the nozzle star 11. In the region of the textile material 3 entering at the top, where the textile material does not as yet cover the sieve drum, and the drum is covered on the inside, the screen 8 is not perforated so that the entering textile material is not subjected to any essential treatment at this point.

Direct flame heating is utilized for heating the treatment medium. For this purpose, burners 12 and 12' are arranged, respectively, in the fan chamber 6 in the housing wall 1 above and below the fan 5. The orifices of the burners 12, 12', to which the fuel as well as the oxygen are fed from the outside, are surrounded by, respectively, one burner housing 13 passing over into an annular duct 14; this duct has a corresponding outlet slot 17 at the level of an annular gap 15 between the fan intake connection 16 and the drum spider 10. In this way, the hot gases pass uniformly distributed over the circumference of the fan intake connection or duct through the annular gap 15 into the fan 5, providing a uniform heating of the air taken in by the fan from the sieve drum.

Figure 1:
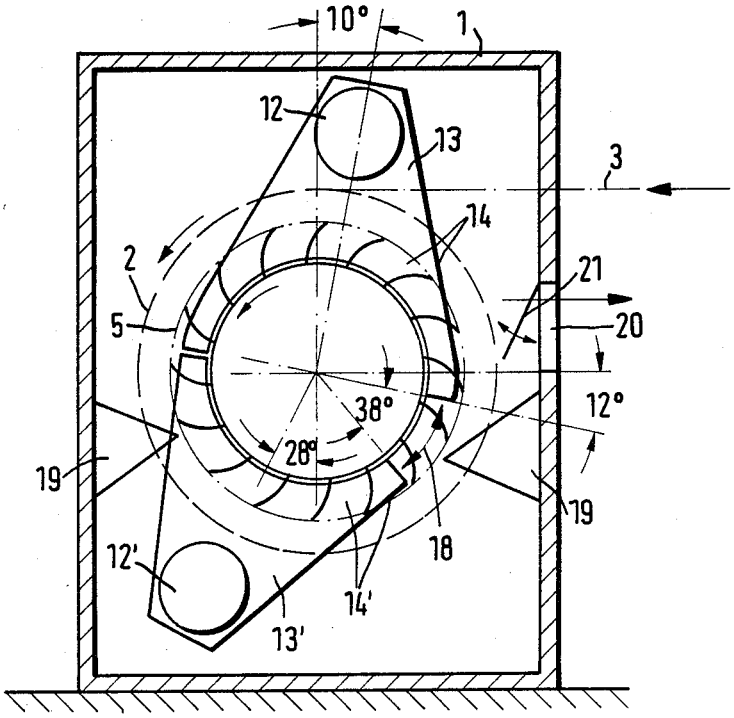
FIG. 1 shows an end sectional view through the fan chamber of a single-drum sieve drum device taken approximately along the line 1—1 in FIG. 2.

As can be seen from FIGS. 1 and 2, two burners 12, 12' are associated with the fan 5, one on the topside and one on the underside. This is to make it possible to effect a differing heating up of the textile material guided on the topside and on the underside. Furthermore, the upper burner, designed to be more powerful, is associated with an annular housing 14 surrounding a larger angle; namely, more than 180°, of the fan intake connection. The annular duct 14' of the lower burner 12', in contrast to duct 14, extends around the fan intake connection by less than 140° whereby a region 18 is cut out by the ducts 14, 14' wherein unheated air is fed to the fan 5 (as hereinafter described).

The air entering the fan intake connection at a certain point exits again at the outer diameter of the fan thereafter, depending on the construction of the fan, in this case, after about 50°. Exploiting this fact, the centers of burners 12, 12' are not arranged on a perpendicular plane through the center of the sieve drum above and below this drum, but rather are arranged so that the centers of each are shifted by an angle against the direction of rotation of the fan and/or of the sieve drum (see arrows). Since the textile material fed to the sieve drum is not yet exposed to a throughflow in the right-hand upper quarter, it is advantageous to locate center (axis) the burner at the top shifted by only about 10° against the direction of rotation of the sieve drum. In contrast, the center of lower burner 12' should be arranged at the bottom shifted against the direction of rotation of the sieve drum by about 30°, preferably 28.5°. In this way, the heated-up treatment air passes to the sieve drum in an optimum fashion.

To attain exact separation of the air flow in the fan chamber 6, baffles (separating panels) 19 are additionally provided in the fan chamber, extending from the housing wall 1 up to the outer diameter of the fan wheel, somewhat below the center of the unit between the upper and lower annular ducts. Thus, while here in the fan chamber an exact separation of the upwardly and downwardly exiting treatment air is enforced, the gases in the treatment chamber around the sieve drum will intermix, which is advantageous for a uniform distribution of the treatment air.

Moisture-enriched air must constantly be exhausted from the circulation of the treatment air in order to replace same by fresh air. For this purpose, an exhaust air nipple or outlet 20 is associated with the fan chamber, the consumed air being blown off through this nipple in dependence on the degree of opening of the exhaust flap 21. Since the heating energy inherent in this exhaust air is lost to the treatment operation, it is advantageous not to reheat the exhaust air again directly prior to being blown off. For this reason, the annular ducts 14, 14' provide a recess in the form of the zone 18 wherein the air is exhausted from the interior of the sieve drum; after passing through the fan, the air is fed in an accelerated fashion to the exhaust air nipple 20. In view of the fact that air taken in at the fan intake connection exits 50° later from the fan, the annular duct 14' will terminate about 50° before the axis of the sieve drum if the exhaust air nipple 20 is disposed above the axis of the sieve drum in the housing 1. The zone 18 proper should amount to 40° or, more accurately, 38° before the annular duct 14 commences thereafter.

What is claimed is:

1. A device for drying textile material which comprises a closed housing accommodating a conveying means comprising at least one sieve drum that is under a suction draft and that is covered to prevent flow-through of gases in a zone of the drum not contacted by the textile material, a fan associated with an end face of said sieve drum for withdrawing a treatment gaseous medium from an interior of the sieve drum and for blowing the treatment gaseous medium back into a space around the sieve drum, an annular gap provided between a fan intake connection and a wall having a drum spider for supporting the sieve drum, said gap being surrounded by two annular ducts which open toward the gap and in each of which is located a burner of a direct flame heating unit, said annular ducts being spaced from each other and each annular duct adjoining and being associated with a selected arcuate portion of the fan intake connection; an upper annular duct being associated with a topside zone of the fan intake connection and a lower annular duct being associated with an underside of the fan intake connection, each burner and associated annular duct being positioned from a perpendicular plane extending through an axis of rotation of the fan by an angle of rotation with respect to the fan and each of the burners being arranged, respectively, at the topside and at the underside in front of the perpendicular plane at an arcuate distance extending in a direction opposite to the direction of rotation of the fan and the lower annular duct being spaced from the upper annular duct to define a recessed zone wherein no flame gases from the burners are fed to the intake connection of the fan and said closed housing having an exhaust gas outlet associated with said recessed zone whereby the gaseous medium discharged into said exhaust gas outlet is not heated by the flame gases.

2. A device for drying textile material which comprises a closed housing accommodating a conveying means comprising at least one sieve drum that is under a suction draft and that is covered to prevent flow-through of gases in a zone of the drum not contacted by the textile material, a fan associated with an end face of said sieve drum for withdrawing a treatment gas medium from an interior of the sieve drum and for blowing the treatment gas medium back into a space around the sieve drum, an annular gap provided between a fan intake connection and a wall having a drum spider for supporting the sieve drum, said gap being surrounded by two annular ducts which open toward the gap and in each of which is located a burner of a direct flame heating unit, said annual ducts being spaced from each other and each annular duct adjoining and being associated with a selected arcuate portion of the fan intake connection; an upper annular duct being associated with a topside zone of the fan intake connection and a lower annular duct being associated with an underside of the fan intake connection, and means for feeding the textile material to an upper surface of the sieve drum, the upper burner associated with the topside of the intake connection having means for providing greater heating power than the lower burner associated with the underside.

3. A device according to claim 2, wherein the annular duct associated with the upper burner surrounds the fan intake connection over a larger arcuate zone of the annular gap than the annular duct associated with the lower burner.

4. A device according to one of claims 2 and 3, further comprising a fan chamber for housing the fan, said fan comprising a radial-flow fan mounted to rotate on an axis of rotation common to the axis of rotation of said sieve drum and baffles extending into each side of the fan chamber from a housing wall up to an outer diameter of the fan, approximately in the center between the upper and lower annular ducts.

5. A device for drying textile material which comprises a closed housing accommodating as a conveying means comprising at least one sieve drum that is under a suction draft and that is covered to prevent flow-through of gases in a zone of the drum not contacted by the textile material, a fan associated with an end face of said sieve drum for withdrawing a treatment gaseous medium from an interior of the sieve drum and for blowing the treatment gaseous medium back into a space around the sieve drum, an annular gap provided between a fan intake connection and a wall having a drum spider for supporting the sieve drum, said gap being surrounded by two annular ducts which open toward the gap and in each of which is located a burner of a direct flame heating unit, said annular ducts being vertically spaced from each other as upper and lower ducts and each annular duct adjoining and being associated with a selected arcuate portion of the fan intake connection and a fan chamber for housing the fan, said fan comprising a radial-flow fan mounted to rotate on an axis of rotation common to the axis of rotation of said sieve drum and baffles extending into each side of the fan chamber from a housing wall up to an outer diameter of the fan, approximately in the center between the upper and lower annular ducts.

6. A device for drying textile material which comprises a closed housing accommodating a conveying means comprising at least one sieve drum that is under a suction draft and that is covered to prevent flow-through of gases in a zone of the drum not contacted by the textile material, a fan associated with an end face of said sieve drum for withdrawing a treatment gaseous medium from an interior of the sieve drum and for blowing the treatment gaseous medium back into a space around the sieve drum, an annular gap provided between a fan intake connection and a wall having a drum spider for supporting the sieve drum, said gap being surrounded by two annular ducts which open towards the gap and in each of which is located a burner of a direct flame heating unit, said annular ducts being spaced from each other and each annular duct adjoining and being associated with a selected arcuate portion of the fan intake connection; an upper annular duct being associated with a topside zone of the fan intake connection and a lower annular duct being associated with an underside of the fan intake connection, the lower annular duct being spaced from the upper annular duct to define a recessed zone wherein no flame gases from the burners are fed to the intake connection of the fan, and said recessed zone being arranged to discharge the treatment gaseous medium into an exhaust air outlet of said closed housing.

7. A device according to claim 6, wherein one side of the recessed zone commences about 50° along an arcuate portion of the gap before reaching the exhaust air outlet.

8. A device according to claim 7, wherein the recessed zone encompasses about 40° of the arcuate portion of said gap.

9. A device for drying textile material which comprises a closed housing accommodating a conveying means comprising at least one sieve drum that is under a suction draft and that is covered to prevent flow-through of gases in a zone of the drum not contacted by the textile material, a fan associated with an end face of said sieve drum for withdrawing a treatment gaseous medium from an interior of the sieve drum and for blowing the treatment gaseous medium back into a space around the sieve drum, an annular gap provided between a fan intake connection and a wall having a drum spider for supporting the sieve drum, said gap being surrounded by two annular ducts which open toward the gap and in each of which is located a burner of a direct flame heating unit, said annular ducts being spaced from each other and each annular duct adjoining and being associated with a selected arcuate portion of the fan intake connection; an upper annular duct being associated with a topside zone of the fan intake connection and a lower annular duct being associated with an underside of the fan intake connection and a fan chamber for housing the fan, said fan comprising a radial-flow fan mounted to rotate on an axis of rotation common to the axis rotation of said sieve drum and baffles extending into each side of the fan chamber from a housing wall up to an outer diameter of the fan, approximately in the center between the upper and lower annular ducts.

10. A device according to claim 9, wherein the lower annular duct is spaced from the upper annular duct to define a recessed zone wherein no flame gases from the burners are fed to the intake connection of the fan.

11. A device for drying textile material which comprises a closed housing accommodating a conveying means comprising at least one sieve drum that is under a suction draft and that is covered to prevent flow-through of gases in a zone of the drum not contacted by the textile material, a fan associated with an end face of said sieve drum for withdrawing a treatment gaseous medium from an interior of the sieve drum and for blowing the treatment gaseous medium back into a space around the sieve drum, an annular gap provided between a fan intake connection and a wall having a drum spider for supporting the sieve drum, said gap being surrounded by two annular ducts which open toward the gap and in each of which is located a burner of a direct flame heating unit, said annular ducts being spaced from each other and each annular duct adjoining and being associated with a selected arcuate portion of the fan intake connection; an upper annular duct being associated with a topside zone of the fan intake connection and a lower annular duct being associated with an underside of the fan intake connection, each burner and associated annular duct being positioned from a perpendicular plane extending through an axis rotation of the fan by an angle of rotation with respect to the fan, and each of the burners being arranged, respectively, at the topside and at the underside in front of the perpendicular plane in an arcuate distance extending in a direction opposite to the direction of rotation of the fan, and a fan chamber for housing the fan, said fan comprising a radial-flow fan mounted to rotate on an axis of rotation common to the axis of rotation of said sieve drum and baffles extending into each side of the fan chamber from a housing wall up to an outer diameter of the fan, approximately in the center between the upper and lower annular ducts.

12. A device for drying textile material which comprises a closed housing accommodating a conveying means comprising a sieve drum that is under a suction draft and that is covered to prevent flowthrough of gases in a zone of the drum not contacted by the textile material, a fan associated with an end face of said sieve drum for withdrawing a treatment gaseous medium from an interior of the sieve drum and for blowing the treatment gaseous medium back into a space around the sieve drum an annular gap provided between a fan intake connection and a wall having means for supporting the sieve drum, said gap being surrounded by an annular duct which opens toward the gap and in which is located a burner of a direct flame heating unit, said annular duct adjoining and being associated with a selected arcuate portion of the fan intake connection, whereby the gaseous treatment medium withdrawn from the interior of the sieve drum entering the fan intake connection is heated by flame gases discharging through said gap and said closed housing being provided with an exhaust gas outlet, said annular duct terminating in a zone preceding an arcuate portion of the fan intake connection that is immediately adjacent to said exhaust gas outlet whereby the gaseous medium discharged into said exhaust gas outlet is not heated by the flame gases in said annular duct.

* * * * *